US006071360A

United States Patent [19]

Gillespie

[11] Patent Number: 6,071,360

[45] Date of Patent: Jun. 6, 2000

[54] CONTROLLED STRAIN RATE FORMING OF THICK TITANIUM PLATE

[75] Inventor: Franna S. P. Gillespie, Auburn, Wash.

[73] Assignee: The Boeing Company, Seattle, Wash.

[21] Appl. No.: 09/093,465

[22] Filed: Jun. 8, 1998

Related U.S. Application Data

[60] Provisional application No. 60/049,016, Jun. 9, 1997.

[51] Int. Cl.[7] ..... C22C 14/00; C22F 1/18

[52] U.S. Cl. ..... 148/421; 148/670; 72/343

[58] Field of Search ..... 148/421, 669, 148/670; 72/60; 172/343

[56] References Cited

U.S. PATENT DOCUMENTS

| | | |
|---|---|---|
| 3,584,487 | 6/1971 | Carlson . |
| 4,087,637 | 5/1978 | Schier et al. . |
| 4,113,522 | 9/1978 | Hamilton et al. . |
| 4,233,831 | 11/1980 | Hamilton et al. . |
| 4,352,280 | 10/1982 | Ghosh . |
| 4,354,369 | 10/1982 | Hamilton . |
| 4,375,375 | 3/1983 | Giamei et al. . |
| 4,658,362 | 4/1987 | Bhatt . |
| 4,713,953 | 12/1987 | Yavari . |
| 5,411,614 | 5/1995 | Ogawa et al. . |
| 5,419,170 | 5/1995 | Sanders et al. . |

FOREIGN PATENT DOCUMENTS

| | | |
|---|---|---|
| 0 379 798 | 8/1990 | European Pat. Off. . |
| 0 408 313 A1 | 1/1991 | European Pat. Off. . |

OTHER PUBLICATIONS

Lapman, Steven et al., Metals Handbook, Properties and Selection: Nonferrous Alloys and Special–Purpose Materials; ASM International, Metals Park, Ohio; 1990, tenth edition, vol. 2, pp. 615–616. Reference designation: XP–002095680.

*Primary Examiner*—Deborah Yee
*Attorney, Agent, or Firm*—John C. Hammar

[57] ABSTRACT

Thick plate is difficult to form because it cracks when localized strain exceeds the limits of the material. Forming thick titanium would significantly reduce manufacturing costs for finished parts by reducing machining time and by allowing standard stock blanks to be used where twelve inch thick or thicker blanks are needed today. Using finite element analysis, we model the plate forming to determine processing constraints that allow forming the thick, coarse grained alpha-beta titanium plate according to SPF principles with controlled strain rates. We form the part at an elevated temperature with a press ram. We complete the part by machining the formed plate, thereby greatly reducing machining time and material cost. Typically we bend a 20 cm thick plate to about 130° with a 5–6 inch inner radius bend, or we form 2 inch thick plate with a complex curvature exceeding twelve inch depth over an area of 30×60 inches.

19 Claims, 7 Drawing Sheets

- Forming temperature = 1,650°F (analysis & test)
- Mean strainrate = $1.3 \times 10^{-4}$ in/in-sec (analysis)
  = $0.35 \times 10^{-4}$ in/in-sec (test)

Fig. 3
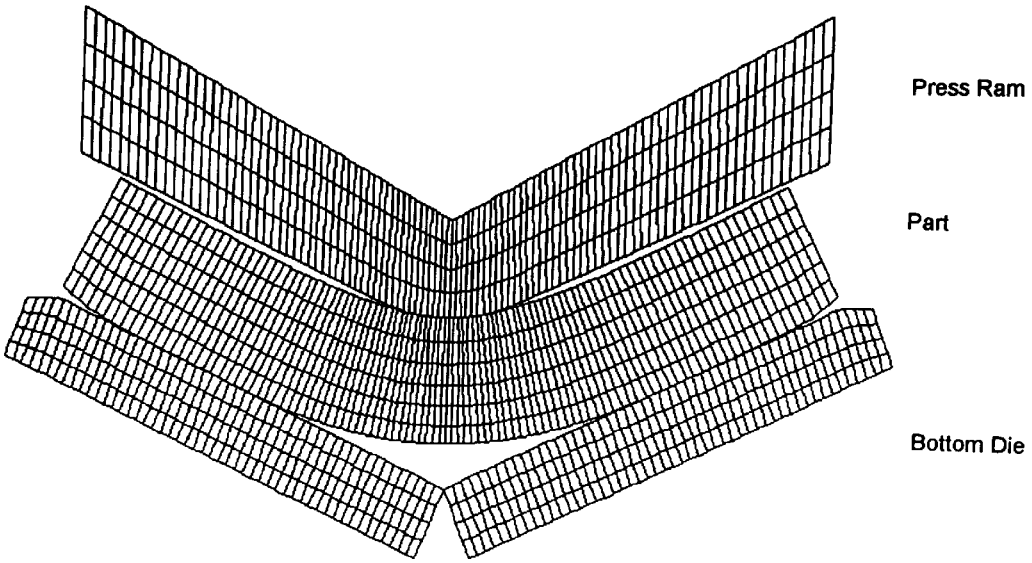
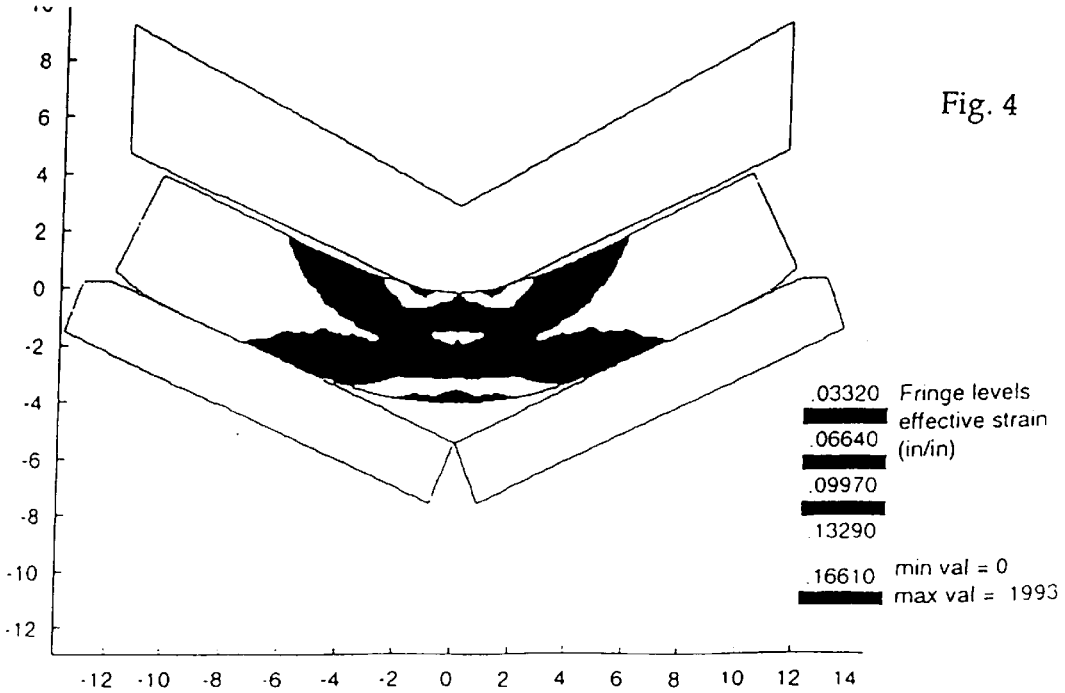
Fig. 4

- Forming temperature = 1,650°F (analysis)
  = 1,500°F (test)
- Mean strainrate = $0.86 \times 10^{-4}$ in/in-sec (analysis)
  = $0.17 \times 10^{-4}$ in/in-sec (test)

- Forming temperature = 1,650°F (analysis & test)
- Mean strainrate = $0.52 \times 10^{-4}$ in/in-sec (analysis)
  = $0.35 \times 10^{-4}$ in/in-sec (test)

CONTROLLED STRAIN RATE FORMING OF THICK TITANIUM PLATE

REFERENCE TO RELATED APPLICATION

The present invention claims the benefit of U.S. Provisional Patent Application No. 60/049,016, filed Jun. 9, 1997.

NOTICE OF GOVERNMENT RIGHTS

This invention was made with Government support under Contract F33657-91C-0006 awarded by the Air Force. The Government has certain rights in this invention.

TECHNICAL FIELD

The present invention relates to forming thick titanium plate (e.g., 20 cm thick) of an alloy that exhibits superplastic behavior in the alpha-beta condition using a controlled strain rate to avoid cracking.

BACKGROUND OF THE INVENTION

Manufacture of large titanium parts is unduly expensive because conventional techniques require the machining (milling) of thick blanks. This technique is expensive. The thick blanks must be specially produced at the titanium foundry. The machining is extraordinary, both in time, the volume of waste chips, and the ratio of starting material to finished part. Often more than 90% of the stock blank will be removed in the machining step. The cost of titanium parts would be greatly reduced if the raw material cost, the machining time, the machining chip waste would be reduced. Attempts to form thick titanium blanks prior to machining, however, have been unsuccessful. The present invention permits the forming of thick titanium plate without cracking using controlled strain rates similar to superplastic forming.

SUMMARY OF THE INVENTION

Thick plate is difficult to form because it cracks when localized strain exceeds the limits of the material and because forces needed exceed the capacity of most forming equipment. Forming thick titanium would significantly reduce manufacturing costs for finished parts by reducing machining time and by allowing standard stock blanks to be used where twelve inch thick or thicker blanks are needed today. Using finite element analysis, we model the plate forming to determine processing constraints that allow forming the thick, coarse grained alpha-beta titanium plate according to SPF principles with controlled strain rates. We form the part at an elevated temperature with a press ram. We complete the part by machining the formed plate, thereby greatly reducing machining time and material cost. Typically we prepare a 20 cm thick plate to about 130° with a 5–6 inch inner radius bend, and 2" thick plate to a complex Contour exceeding 12" depth over an area 30"×60".

The method of the present invention for hot forming alpha-beta, course grain, 20 cm thick titanium plate, involves heating the plate in a matched dieset; forming the heated plate using a controlled strain rate characteristic of superplastic titanium without cracking the plate by moving a male die of the dieset against the plate at a controlled pressure and speed; and restraining the forming with a female die to achieve about a 130° bend with a 6 inch radius.

The invention also relates to a method for making a titanium part, involving forming thick titanium plate using superplastic forming principles with hot forming tooling by applying a controlled strain rate selected to keep the plate from cracking; and machining the formed plate to remove material and shape the plate into a finished part. Forming greatly reduces the volume of machining necessary by allowing a thinner blank to assume roughly the configuration of the finished part. That is, we roughly "net shape" a flat plate into a bent block before machining the block to the desired configuration.

We advance a male platen incrementally followed by stress relaxation of the plate to relieve load. In this fashion, we do not exceed the load capacity of the press (600 tons) and avoid cracking in the part.

BRIEF DESCRIPTION OF THE DRAWINGS

FIG. 3 show a finite element grid for a partially formed part.

FIG. 4 shows the typical plastic strain distribution near the end of the forming cycle.

DETAILED DESCRIPTION OF A PREFERRED EMBODIMENT

Integrally stiffened skin panels for the aft fuselage of an aircraft can now be machined from four-inch thick Ti-6Al-4V plate that has been preformed to a simple crease bend with a 30 degree angle from horizontal and a six inch inside radius. Initial attempts to cold form the plate were unsuccessful. Hot forming at temperatures in the superplastic range, such as 1650° F., in an operation corresponding to superplastic forming can be done within the capability of a typical 600-ton press. Preforming allows us to use a four-inch thick blank rather than a ten inch thick one, saving more than 60% of the machining. The four-inch thick blank is a standard foundry size, so it is cheaper and quicker to obtain than a 10 inch blank. A ten inch blank requires a special foundry run.

Calculations for both a 4×12×24 inch trial part and the 4×36×90 inch full size part indicated a simple cylindrical male die would allow the sheet to curl away from the female die. Forming temperatures in the superplastic range of the material result in loads well within the capacity of the press. A matching die set having a male press ram and a female die would constrain the part and produce the desired shape. Our analysis of load and strain agreed with the load versus displacement and maximum load actually required.

Figure 2:
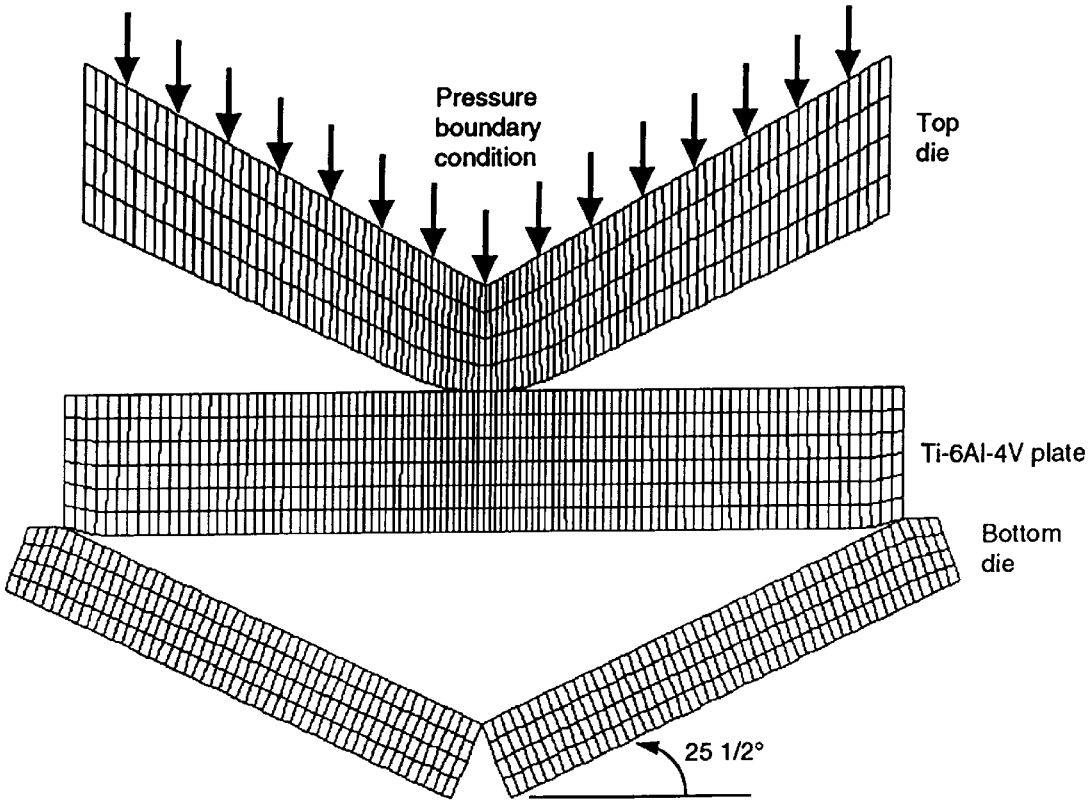
FIG. 2 shows a finite element grid for modeling the forming of thick Ti-6Al-4V plate using a press ram male die to force the plate into a female die.

Our finite element analysis used the implicit code "Nike2d," obtained from Lawrence Livermore National Laboratory (LLNL). Key features of the finite element model for the 4×12×24 inch trial part are given in FIG. 2. We assumed 2-D plane strain. The model took advantage of the central symmetry plane in the part to reduce problem size by one-half. The female die was fixed in space in the model and selected nodes of the upper die were coupled or constrained to move together in both displacement coordinates to prevent rotation of upper die. The pressure boundary condition was applied over the top surface of the upper die and was controlled with a load curve, which could be tailored to deliver the desired strain rates. The 2-D model assumed a displacement length of one inch and then calculated the applied load per lineal inch of plate (lb/in) from the pressure times the 24 $in^2$ area of the model (36 $in^2$ for the full size part). These model results would then be applied to the actual parts by multiplying the calculated applied load per lineal inch by the plate length: 12 inches for the trial part and 90 inches for the large plate. The outer mating edges of the titanium plate and bottom die were chamfered to avoid contact problems with sharp corners. The trial part inside radius was five inches while the targeted full size part had a six-inch radius. The tighter radius of the trial part was selected to impose higher local strain levels and add a margin of confidence for forming the full size part. For the pretest analysis, the bend angle used for the trial part was 25½ degrees and that for the full size part was 30 degrees.

An estimate based on superplastic sheet material properties for the material yield stress of 2000 to 2500 psi at a nominal strain rate of 1.0e-04 in/in-sec guided our selection of the constants in the strain rate dependent material model (model 19) used in the analysis. These constants were the strength coefficient, K=225e03 psi, and the strain rate exponent, m=0.50.

Figure 1:
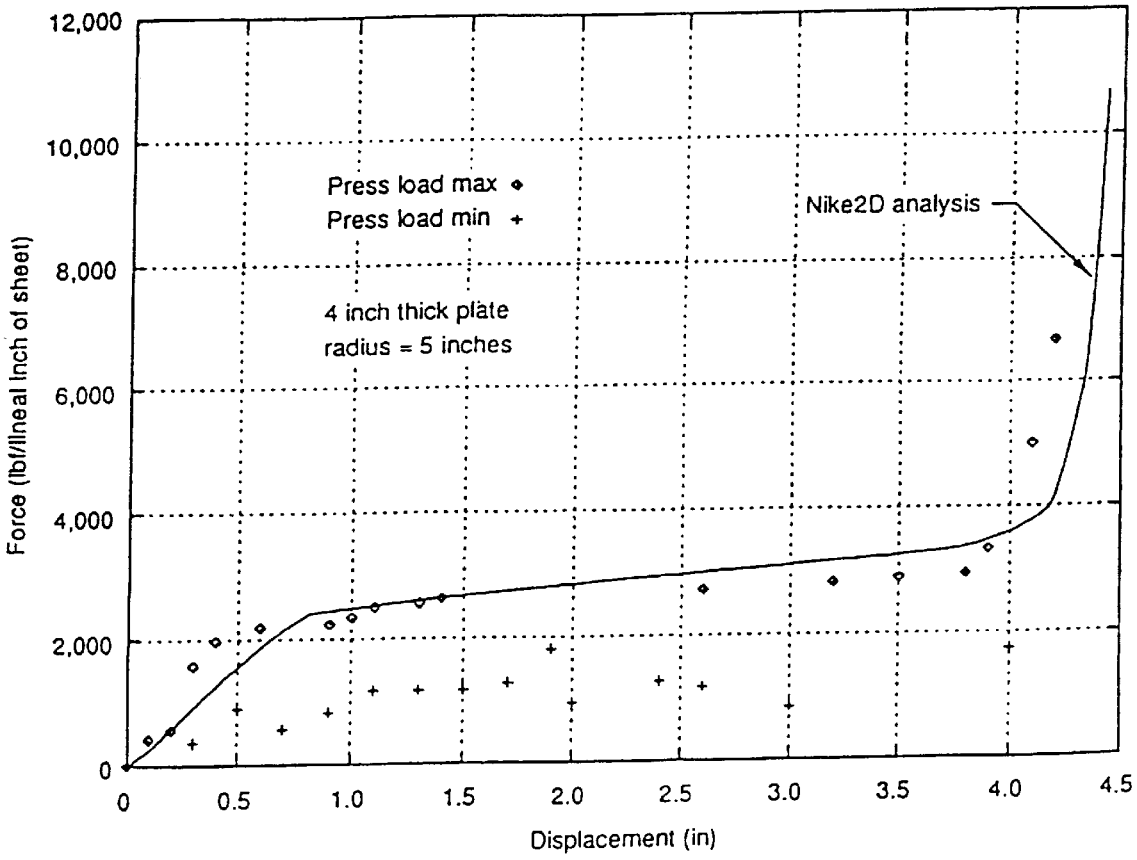
FIG. 1 is a graph showing the typical relationship between displacement of a thick titanium blank as a function of the press ram force (in lb/lineal inch of the blank).

A description of the partially formed part is given in FIG. 3, near the end of the down stroke. The sheet has a natural tendency to curl up near the end of the forming stroke and the load could be expected to rise to very large levels as the curl is flattened out. The plastic strain distribution is shown in FIG. 4 at this same time. The maximum plastic strain when fully formed was 0.25. The predicted load-displacement relationship for the trial plate is given in FIG. 1. The pressure load curve was tailored to yield nominal strain rates of $2.0\times10^{-4}$ in/in-sec and the force at any time could then be calculated from the product of pressure times the projected area of the upper die (i.e., the press ram). Vertical displacement histories for a node located on the bottom center of the plate were readily available from the solution and a time correlation of load and displacement then produced the Nike2d analysis curve of FIG. 1. Since the press lacks a feature for smooth continuous load application, the load was increased in small steps followed by a pause for stress relaxation. The result was a sawtooth applied load pattern that bounced between the maximum and minimum test data shown. The peak load profile of the model agreed well with the actual data, including the prediction of a steep rise at the end of the forming stroke. Two compensating errors were made with this model of the trial part. First, the bend angle was closer to 30 degrees than the 25½ degrees in the model. There actually was a two-inch flat shoulder at the outside edge of the female die, which was neglected in the model. The net result, however, was a nearly correct stroke length and a reasonable comparison between test and analytical results.

Figure 5:
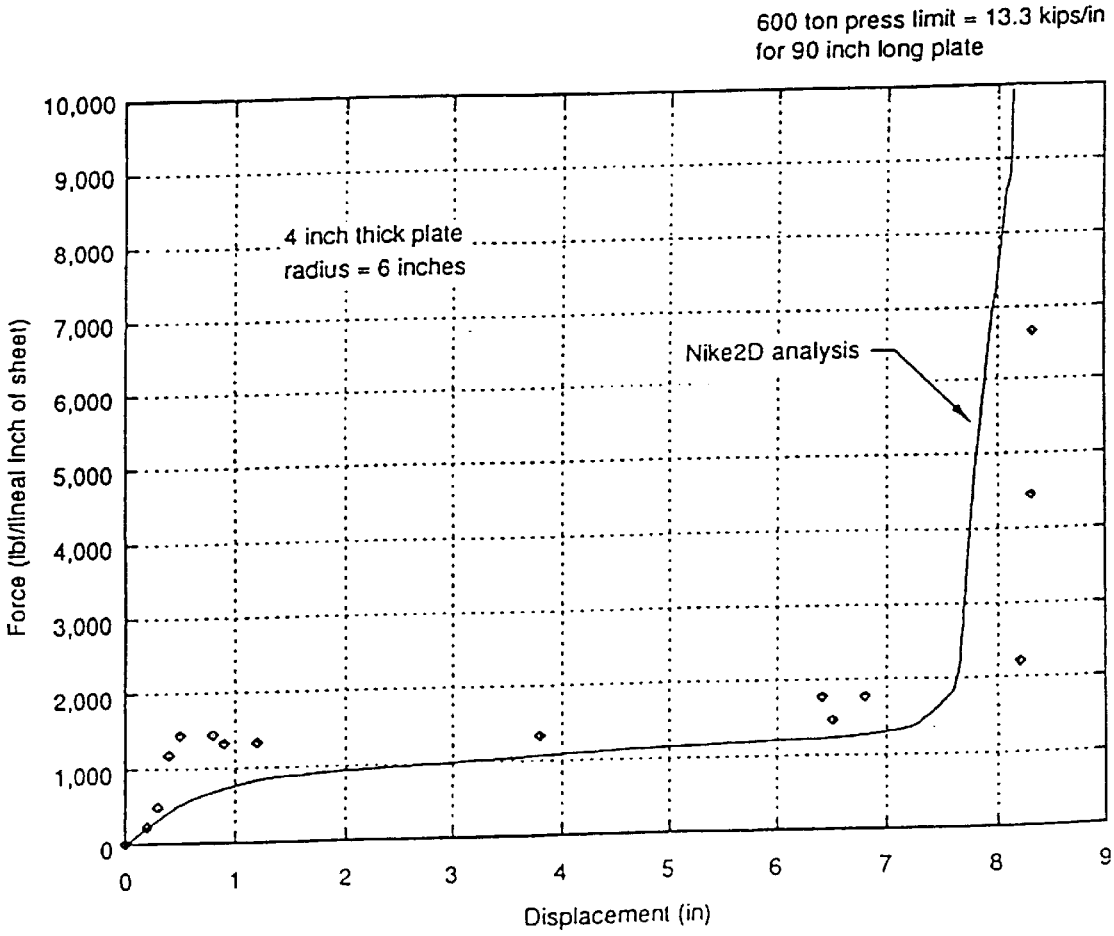
FIG. 5 shows displacement as a function force for forming a 90×36 inch, 4 inch thick Ti-6Al-4V plate into a 30° bend angle having an inner radius bend of 6 inches.

The same method was applied to yield the estimates for the full size part shown in FIG. 5. The press limit for 600 tons applied over a 90-inch-long plate is 13.3 Kips/inch. Again, the model agreed well with the actual forming data.

For reasons possibly related to the massive size of the large sheet, the forming temperature we actually used for bending the large plate test part was lower than desired, 1500° F. instead of 1650° F., but still within the superplastic range of the material. The initial portion of displacement in the data in FIG. 5 shows elastic deformation. The lack of correspondence here with the model is probably attributable to an inappropriate value for elastic modulus at the lower temperature.

The pressure-time load curve used in the model was a compromise between achieving the target maximum strain rate and obtaining a numerical solution. The result was an initial strain rate somewhat higher (2 to $3\times10^{-4}$ in/in-sec) and a final rate (during the last ½ to one inch of motion) somewhat lower ($0.65\times10^{-4}$ in/in-sec) than the desired $1\times10^{-4}$ in/in-sec. The overall average strain rates actually experienced in the part were substantially lower than the model. The material flow stress is a strong function of both temperature and strain rate. The correspondence between the model and actual data should be poorer as these parameters disagree. During the plastic flow process, the mismatch in strain rate and temperature (analysis to test) are compensating factors, i.e. the low test strain rate should result in a theoretical force too high, while the lower test temperature should result in a theoretical force estimate that is too low. Hence the relative correspondence despite the "errors."

Figure 6:
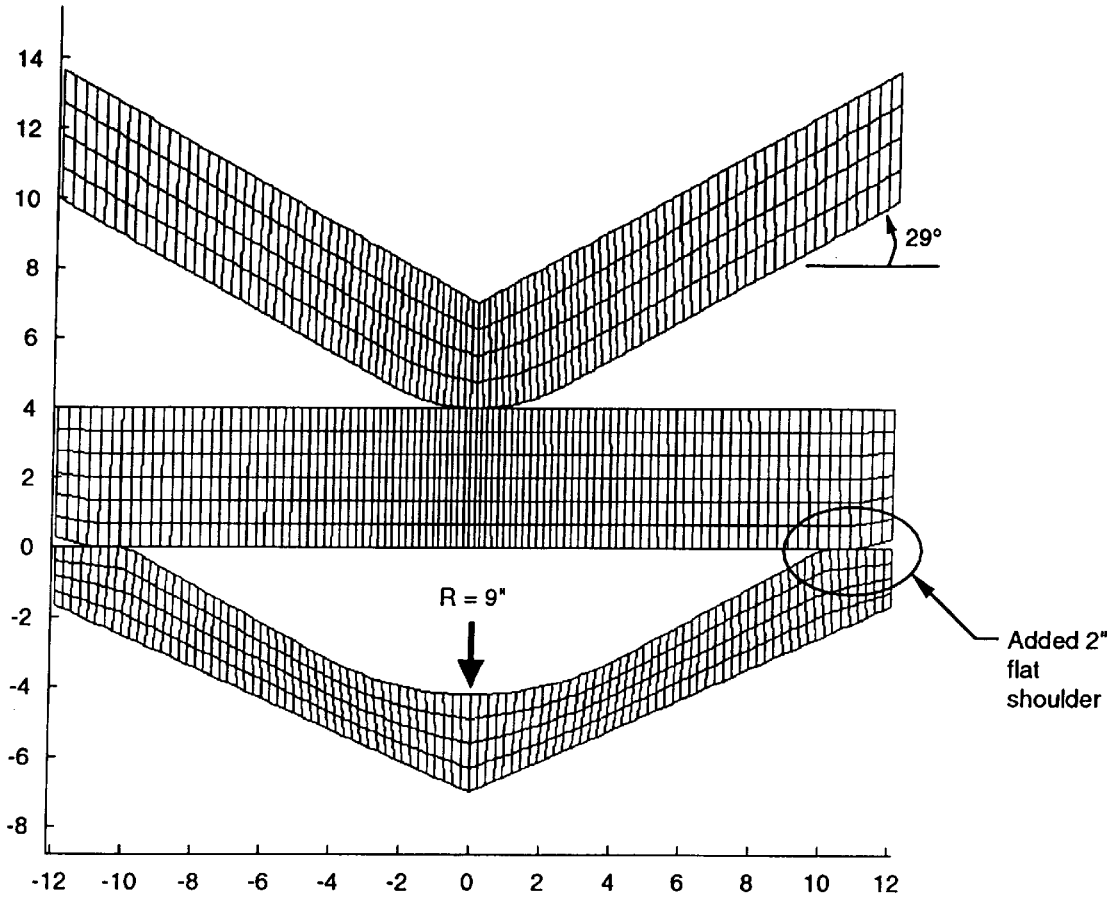
FIG. 6 shows a finite element grid for modeling the forming of thick plate using a peripheral shoulder.
Figure 7:
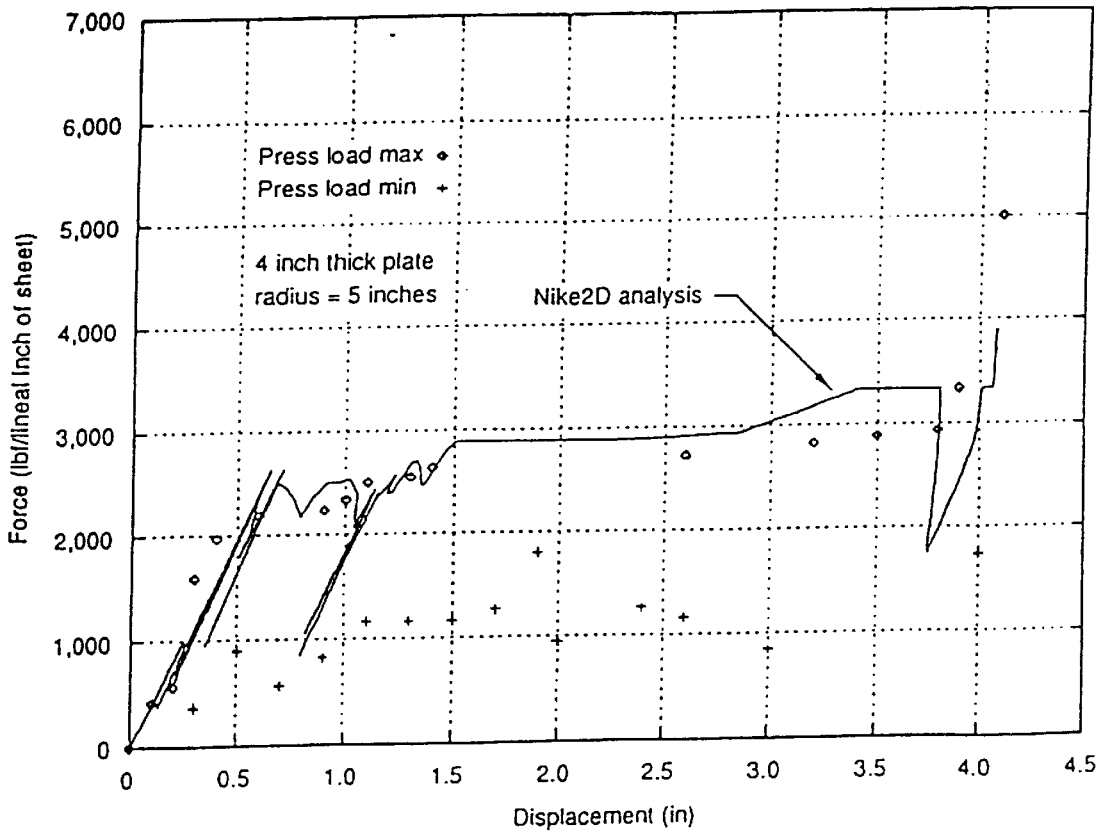
FIG. 7 is a graph showing displacement as a function of force and the correspondence of the model with the actual test load history for forming the plate.

We made corrections in the model to the die configuration for the trial part and the pressure load curve was derived from load measurements at the press. For this configuration (FIG. 6) the 24-inch span, 2 inch flat shoulders, 9-inch bottom die radius, 29 degree bend angle and 4.2 inch test stroke length are all internally consistent. The press was operated by advancing the upper platen to a load level as predicted from the load-displacement curve of the earlier analysis and within a time frame to yield the overall desired mean strain rate. Then the position was held while the load was relieved by stress relaxation. Since the model included a pressure boundary condition, the intermediate holds in the actual process are not included in the model. Elastic spring-back occurred in the model predictions with the sawtooth load curve, as shown in FIG. 7.

Figure 8:
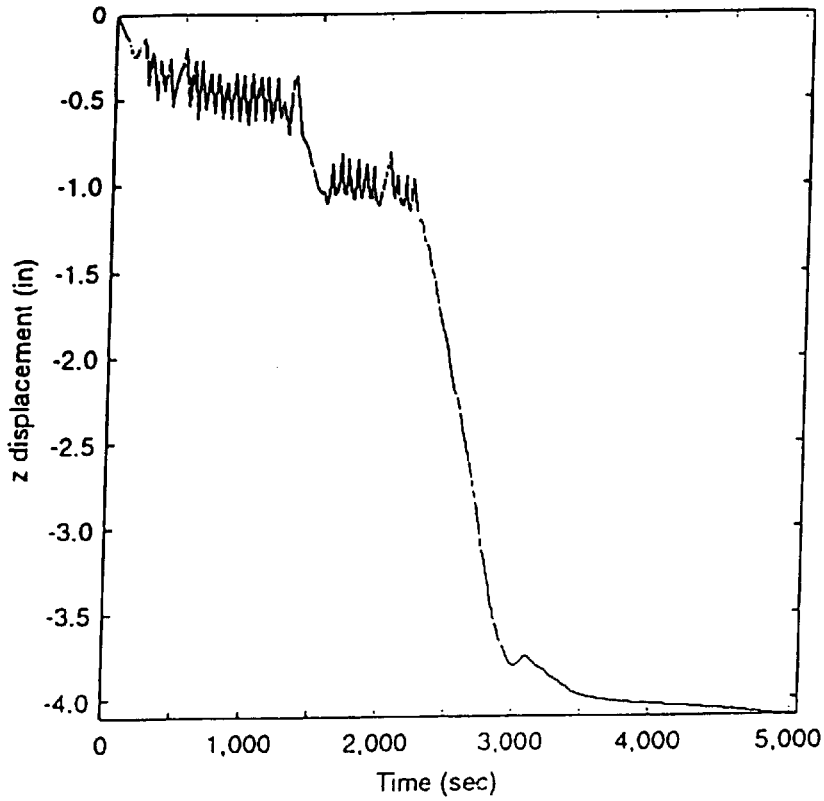
FIG. 8 is a graph showing displacement as a function of time (the displacement history) at the center of a formed trial part.
Figure 9:
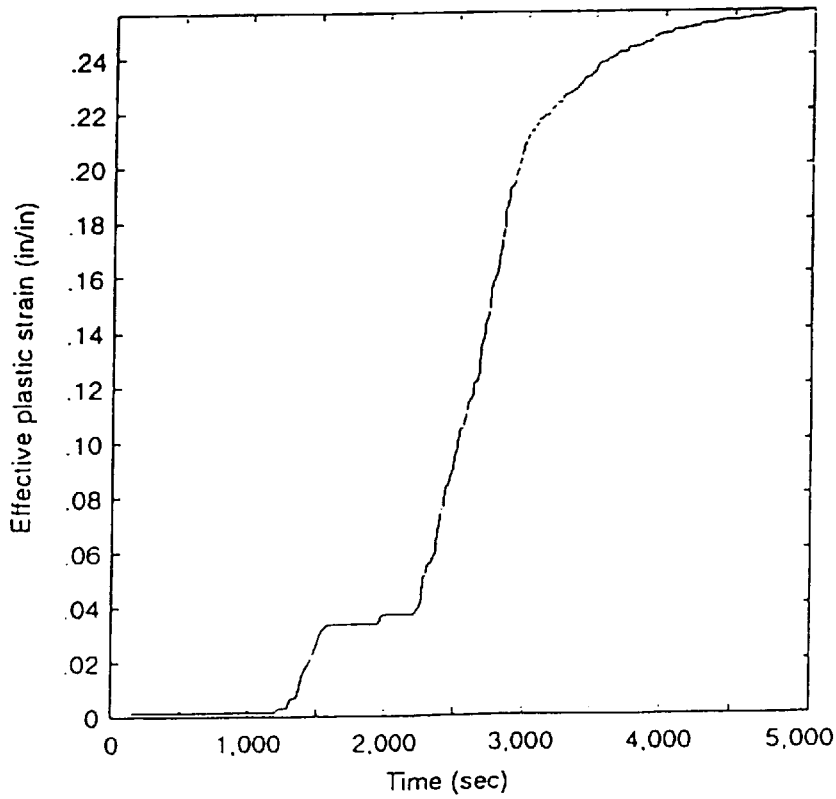
FIG. 9 is a graph showing effective plastic strain as a function of time (the strain history), similar to FIG. 8, for a formed part.

The elastic spring back can be seen clearly (FIG. 8) with the displacement history for node 1 at the bottom-center of the plate. A greater portion of the plate was still elastic during the first 2500 seconds. Even more instructive is the element plastic strain history (FIG. 9). The total process mean strain rate would be estimated as $0.52\times10^{-4}$ in/in-sec. The maximum rate in the central time frame actually was $2.4\times10^{-4}$ in/in-sec. The initial flat period is elastic deformation for the first 1200 seconds and 0.5 inch displacement. That was followed by plastic flow at a strain rate of $>2.0\times10^{-4}$ in/in-sec to a step (t=1500 to 2200 sec) with elastic oscillations during stress relaxation.

Following the forming to roughly the net shape of the part, we machine the formed part on a 5-axis, 6-axis, or other suitable machining station to complete the part to the desired, final configuration. Because we have reduced the initial plate thickness from 50 cm to 20 cm (10 inches to 4 inches, nominally), the machining operation is significantly reduced.

Once properly configured, the part can be annealed or treated in other operations before it is assembled into the desired aircraft structure.

While we have described preferred embodiments, those skilled in the art will readily recognize alterations, variations, and modifications that might be made without departing from the inventive concept. Therefore, interpret the claims liberally with the support of the full range of equivalents known to those of ordinary skill based upon this description. The examples are given to illustrate the invention and not intended to limit it. Accordingly, limit the claims only as necessary in view of the pertinent prior art.

I claim:

1. A method for hot forming a simple crease bend into alpha-beta, coarse grain, thick titanium plate having a thickness of at least about 10 cm, comprising the steps of:

(a) heating the thick plate in a matched dieset defining the crease of about 25–30° to a superplastic temperature of the plate;

(b) forming the heated plate into the crease having a radius of about 12.5–22.5 cm (5–9 inches) using a controlled strain rate characteristic of superplastic titanium without cracking by moving a male die of the dieset against the plate stepwise at a controlled pressure and speed causing a displacement incrementally to about 10–20 cm;

(c) restraining the displacement during forming with a female die to achieve the desired contour; and (d) machining the creased plate to a desired final configuration, wherein the forming includes elastic deformation initially followed by plastic flow with elastic oscillations during stress relaxation.

2. The method of claim 1 wherein the plate is heated to about 1650° F.

3. The method of claim 2 wherein the mean strain rate is less than about $0.35\times10^{-4}$ in/in-sec.

4. The method of claim 3 wherein the plate forming follows the displacement curve as a function of applied force substantially of FIG. 5.

5. A formed plate that is the product of claim 4.

6. The method of claim 1, further comprising the steps of:

(a) determining areas of maximum strain in the plate during the forming using finite-element analysis of the plate and relationship of displacement as a function of applied force; and;

(b) selecting a mean strain rate appropriate to form the plate without cracking.

7. The method of claim 6 wherein forming occurs by applying from 2000–8000 lb/lineal inch of the plate.

8. The method of claim 1 wherein forming involves advancing the male die in incremental steps to yield the overall desired mean strain rate and holding the male die in an incremental step position while relieving the load in the plate with stress relaxation, thereby allowing further forming without cracking.

9. The method of claim 1 wherein the contour of the crease bend is substantially a 130° bend with a six inch radius.

10. A method for making a thick titanium part, comprising the steps of:

(a) forming at least a 10 cm thick titanium plate into a crease bend having a curvature of about 30° using superplastic forming principles with hot forming tooling by applying a controlled strain rate selected to keep the plate from cracking by forcing a ram incrementally against the plate in a matched dieset; and (b) machining the formed plate to remove material to shape the plate into a finished part, and wherein the forming includes elastic deformation initially followed by plastic flow, and wherein forming greatly reduces the volume of machining necessary by allowing a thinner blank to assume roughly the configuration of the finished part.

11. The method of claim 10 wherein the plate has alpha-beta coarse grain structure, wherein forming occurs at about 1500–1650° F. with a press ram at a mean strain rate of no more than about $0.35\times10^{-4}$ in/in-sec.

12. A finished part made by the method of claim 11.

13. The method of claim 11 wherein forming occurs with the displacement relationship as a function of applied force substantially of FIG. 5.

14. A finished part made by the method of claim 13.

15. The part of claim 14 wherein the plate is Ti-6Al-4V.

16. The method of claim 11 further comprising the step of supporting the periphery of the plate at a shoulder of a female die into which the plate is formed.

17. The method of claim 10 wherein forming includes the steps of:

(a) advancing a male platen an incremental amount;

(b) stopping the male platen;

(c) stress relaxing the plate to relieve load in the plate; and (d) advancing the male platen another incremental amount, thereby allowing further forming without cracking.

18. A part made by the method of claim 17.

19. The method of claim 11 wherein forming involves:

(a) advancing the press ram a predetermined incremental distance;

(b) holding the press ram in that incremental position; and (c) stress relaxing the plate at the incremental position to relieve load in the plate, thereby allowing further forming without cracking.

* * * * *